US011449008B2

(12) United States Patent
Gauche et al.

(10) Patent No.: US 11,449,008 B2
(45) Date of Patent: Sep. 20, 2022

(54) WATCH CASE COMPRISING A CAPSULE HELD IN PLACE IN A MIDDLE BY A REAR BEZEL

(71) Applicant: G&G CONCEPT, Le Vésinet (FR)

(72) Inventors: Gregory Gauche, Clisson (FR); Henrick Gauche, Le Vésinet (FR)

(73) Assignee: G&G CONCEPT, Le Vésinet (FR)

( * ) Notice: Subject to any disclaimer, the term of this patent is extended or adjusted under 35 U.S.C. 154(b) by 572 days.

(21) Appl. No.: 16/480,774

(22) PCT Filed: Jan. 25, 2018

(86) PCT No.: PCT/FR2018/050174
§ 371 (c)(1),
(2) Date: Jul. 25, 2019

(87) PCT Pub. No.: WO2018/138443
PCT Pub. Date: Aug. 2, 2018

(65) Prior Publication Data

US 2020/0019120 A1 Jan. 16, 2020

(30) Foreign Application Priority Data

Jan. 25, 2017 (FR) ..... 17/50610

(51) Int. Cl.
*G04B 37/00* (2006.01)
*G04B 37/04* (2006.01)

(52) U.S. Cl.
CPC ..... *G04B 37/005* (2013.01); *G04B 37/0041* (2013.01); *G04B 37/0463* (2013.01)

(58) Field of Classification Search
CPC .. G04B 37/005; G04B 37/12; G04B 37/0041; G04B 37/05; G04B 45/0092;
(Continued)

(56) References Cited

U.S. PATENT DOCUMENTS 3,264,820 A 8/1966 Piquerez
5,392,261 A * 2/1995 Hsu ..... G04B 37/1413 368/281

(Continued)

FOREIGN PATENT DOCUMENTS

FR 2122547 A1 9/1972
FR 2965073 A3 3/2012
JP H09-189776 A 7/1997

OTHER PUBLICATIONS

International Search Report (PCT/ISA/210) dated May 28, 2018, by the European Patent Office as the International Searching Authority for International Application No. PCT/FR2018/050174. (5 pages).

(Continued)

*Primary Examiner* — Edwin A. Leon
(74) *Attorney, Agent, or Firm* — Buchanan Ingersoll & Rooney PC

(57) ABSTRACT

A watch case includes a capsule receiving a watch mechanism, arranged along a main axis, and which includes a front side that has the watch face. The watch case further includes a middle surrounding the capsule and provided with an essentially cylindrical housing open toward the back from which side it receives the capsule. The watch case further includes a bezel placed against the back of the capsule. The bezel includes tabs arranged on the outer contour of the capsule, which are in a blocking position partly inserted in the interior of at least one groove having a circular orientation, produced in the cylindrical part of the housing of the middle.

10 Claims, 5 Drawing Sheets

(58) Field of Classification Search
CPC ..... G04B 37/0463; G04B 37/084; G04B 37/057; G04B 45/0069; G04B 37/1406; G04B 37/1413; G04G 17/08
See application file for complete search history.

(56) References Cited

U.S. PATENT DOCUMENTS

| | | | | |
|---|---|---|---|---|
| 7,177,234 | B1 * | 2/2007 | Paul | G04B 45/0092 368/88 |
| 8,899,826 | B2 * | 12/2014 | Pilz | G04B 37/1406 368/278 |
| 2012/0069718 | A1 | 3/2012 | Pilz | |

OTHER PUBLICATIONS

Written Opinion (PCT/ISA/237) dated May 28, 2018, by the European Patent Office as the International Searching Authority for International Application No. PCT/FR2018/050174. (6 pages).

* cited by examiner

WATCH CASE COMPRISING A CAPSULE HELD IN PLACE IN A MIDDLE BY A REAR BEZEL

CROSS REFERENCE TO RELATED APPLICATIONS

This application is a U.S. National Stage application under 35 U.S.C. § 371 of International Patent Application No. PCT/FR2018/050174 filed on Jan. 25, 2018, which claims priority to French Patent Application No. 17/50610 filed on Jan. 25, 2017, the entire contents of both of which are incorporated herein by reference in their entireties for all purposes.

FIELD

The technical field of the invention is that of watch cases, and more particularly watches to be worn on the wrist, or fob watches.

SUMMARY

The watches worn on wrists generally include a flat watertight case, most often of a circular shape, having a body which receives, on its upper face, a glass which covers the dial and the needles, and, on its lower face, a back cover.

The case has, on each side, two arms receiving, between same, a transverse needle bar, which engages into a loop of a strap portion positioned on this side. One or more crown(s) arranged on the sides have a radial axis which enters the mechanism so as to ensure the settings and the controls of the watch.

A known watch type includes a two-portion case comprising a generally circular watertight capsule having a main axis containing the watch mechanism, comprising, on its upper face, the dial and the glass thereof, and a middle forming an outer contour which receives the capsule, comprising the bracelet fastening arms on each side.

The middle may additionally have auxiliary functions. The middle can thus be changed specifically while keeping the same capsule, in order to have, at a reduced cost, watches with different looks.

According to a known embodiment of this type of watch, the capsule is introduced from the front into a housing of the middle, with a circular outer rim of the capsule bearing on the front face of the middle.

A bezel forming a circular ring, and provided with an inner thread, is then screwed onto a matching thread provided at the rear of the capsule in order to ensure an axial clamping of the middle which is sandwiched between the front outer rim and the bezel.

This assembling system is simple and economical to produce, and ensures a firm attachment. However it raises problems. In particular, the bezel screwed on the capsule has to be circular to be screwed, which limits the creation of different shapes. Besides, the bezel may unscrew and fall without the user noticing it. Besides, the bezel is a thin component which may easily warp or be screwed askew on the capsule thread, which results in a cross-threading of the capsule, which is the most expensive element.

According to another known embodiment of this type of watch, the capsule comprising, on the front, an outer rim, is introduced from the front into the middle which has a cover attached to the middle by means of a lateral pivot, forming a ring which covers the contour of the capsule to hold same in place.

The cover is locked on the middle by pressing the contour of the capsule, by means of a system of hooks pushed by a spring, which are automatically hooked when the cover is closed on the middle.

A middle with a technical inventive aspect is thus obtained, which may be suitable for the image shown by some watch brands.

This assembling system is however fragile because of the number of parts required for locking the cover, and the behaviour thereof overtime is uncertain. Reliability within the scope of a sports use which may involve strong mechanical constraints may specifically be limited.

According to a known embodiment of this type of watch, the capsule is inserted into the housing of the middle from the front, and blocked by balls pushed by springs which adjust in matching recesses formed on the contour of the capsule, in order to ensure the axial holding thereof.

An additional crown positioned laterally goes through the middle to be screwed in the capsule so as to provide a complete locking of the capsule.

This is an easy locking solution, but the long-term reliability thereof is not guaranteed. In act, the springs which press the balls may oxidise, which would limit the middle service life. Besides, a volume has to be provided for accommodating the ball locking means, which involves aesthetic constraints on the middle.

The aim of the present invention is to remedy the drawbacks of the prior art.

For this purpose, it provides for a watch case comprising a capsule which receives the watch mechanism, arranged along a main axis comprising a front side with the watch face, and including a middle surrounding such capsule having an essentially cylindrical housing opening towards the back from which side it receives the capsule, such case being characterized in that it comprises a bezel placed against the back of the capsule, comprising tabs arranged on the outer contour of the capsule, which are in a blocking position partly inserted into at least one groove having a circular orientation, produced in the cylindrical part of the housing of the middle.

One advantage of this watch case is that, after introducing the capsule with the bezel arranged on the rear face in the middle, the tabs being inserted between the capsule and the housing of the middle, the tabs can be moved along slopes provided on the outer contour of the capsule and by rotating the bezel, and same tabs can simply be radially spaced to be introduced into one or more groove(s) having a circular orientation of the housing of the middle.

As the tabs are axially locked in the grooves having a circular orientation cannot slide towards the back, an efficient and rigid holding of the bezel and the capsule in the middle is economically obtained. Besides, the tabs inserted into the gap between the capsule and the middle are invisible, which gives a neat appearance.

The watch case according to the invention can further include one or more following characteristic(s), which may be combined together.

The watch case advantageously includes, relative to the axis, an angular position for assembling the capsule and the bezel through an axial sliding in the housing of the middle, and a different angular position for blocking the bezel, wherein the tabs are partly inserted into the circular groove(s).

The outer contour of the capsule advantageously comprises grooves which receive the tabs, having a bottom sloping in the circumferential direction. The tabs can be easily inserted into the groove(s) of the middle by sliding along the slope and by rotating the bezel.

The contour of the bezel advantageously has marks indicating the assembly and blocking angular positions. The correct blocking position of the bezel is thus ensured.

More particularly, the tabs may have, from the circular contour of the bezel, an axial part, then a circumferential part provided to be inserted into a circular groove. The circumferential part is thus radially resilient.

More particularly, the bezel may include, at the back, a circular contour which is integrated in a step provided around the rear face of the capsule. The circular contour is then integrated in the thickness of the capsule.

In this case, the circular contour of the bezel has a conical shape which fits on a matching shape at the bottom of the step of the rear face of the capsule.

The contour of the bezel advantageously has raised shapes.

The middle advantageously includes a shape for blocking the rotation of the capsule. The bezel can thus be easily rotated without driving the capsule into rotation.

In this case, the shape for blocking the rotation advantageously is a radial slot which receives a tube surrounding the axis of an adjusting crown of the capsule.

Another object of this invention is a watch middle adapted to receive in an essentially cylindrical housing open towards the back a capsule containing the watch mechanism, held by a bezel placed against the back of the capsule, comprising tabs arranged on the outer contour of the capsule, such middle including, in the cylindrical part of the housing at least one groove having a circular orientation which will partly receive the tabs, in a blocking position.

BRIEF DESCRIPTION OF THE DRAWINGS

Further characteristics and advantages of the invention will be clear from reading the following description, made in reference to the appended figures, which show.

DETAILED DESCRIPTION

For greater clarity, identical or similar elements are identified by identical reference signs in all the figures.

Figure 1:
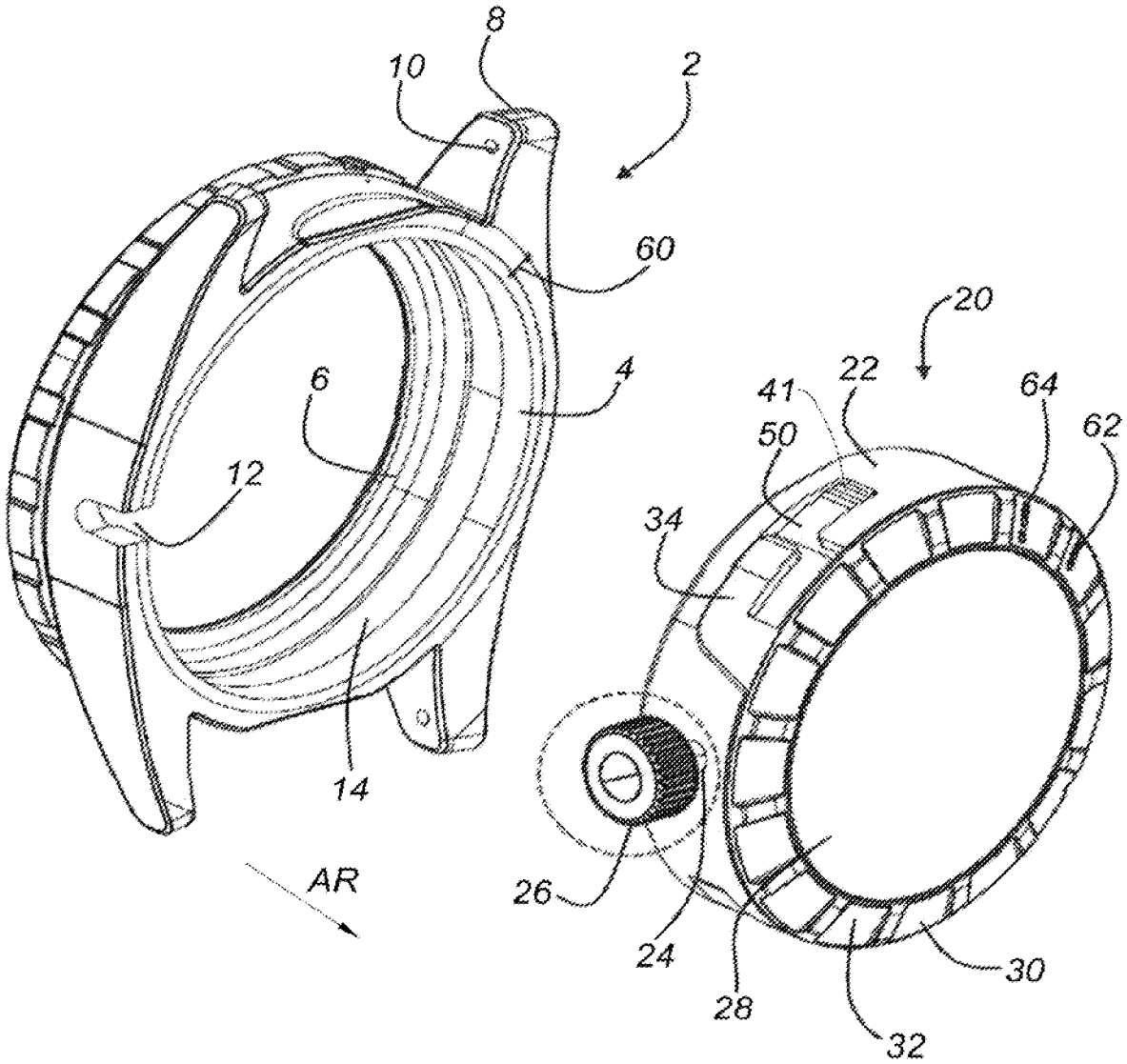
FIG. 1 shows a watch case according to a first embodiment of the invention, with the capsule having its bezel separated from the middle.
Figure 2:
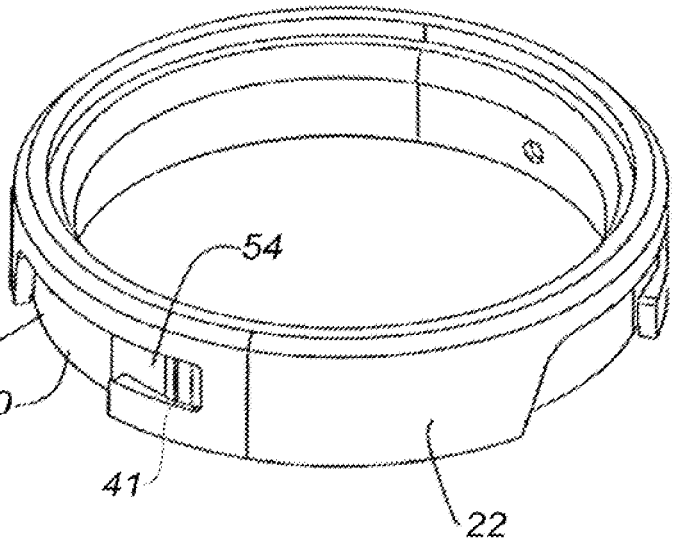
FIG. 2 shows the capsule contour part according to this embodiment.

FIGS. 1 to 2 show a watch case according to a first embodiment, and more particularly a middle 2 comprising a cylindrical housing 4 open towards the back side, marked with the "AR" arrow, thus receiving the close-fitted cylindrical outer contour 22 of a capsule 20. The outer contour 22 of the capsule 20 can also have another shape different from the cylindrical shape shown here.

The housing 4 of the middle 2 ends, in front, in a circular rim 6 slightly jutting out towards the inside of the housing, and forms a support for the front contour of the capsule 20.

The middle 2 has, on each side, two substantially parallel horns 8, each having a piercing 10 opposite one another, and receiving a needle bar (not shown), also called a pump, which is accommodated in one loop of a part of the bracelet.

One side of the middle 2 has a radially oriented slot 12, which opens towards the back, receiving in an adjusted way a tube 24 surrounding the rod of a crown 26 of the capsule 20, which is screwed or countersunk in such capsule. The assembly consisting of the tube 24 and the crown 26 results in a watch mechanism adjustment knob integrated in the capsule 20.

The middle 2 is provided, on the contour of its housing 4, a continuous circular inner groove 14 shifted relative to the rear end of such housing. As an alternative solution, the groove 14 can be continuous, and have distinct circular parts.

The capsule 20 has a flat rear part 28 including a slightly conical contour which is shifted towards the front, so as to form a small step around such flat back part.

A bezel 30 includes a slightly conical circular contour which fits the conical contour of the capsule 20, so as to be incorporated into the step around the flat rear face 28 and fits at such rear face. The bezel can be made from a cut metal sheet, or any other material, such as a composite material for instance.

The contour of the bezel 30 includes a series of radially positioned and angularly distributed raised shapes 32 which are gripping means enabling to rotate the bezel by hand.

The rear face of the middle 2 has a radial mark 60 which may be positioned opposite a boss between two recesses 32 in the bezel 30 having a mark indicating the <<OPEN>> unlocking position 62 or the <<CLOSE>> blocking position 64. Of course, these marks can be different in this embodiment and are not limited to etching the positions. Such etching can for instance be replaced by one or more symbol(s) or any other mark(s) adapted to such use, i.e. to indicate the locking state.

Figure 3:
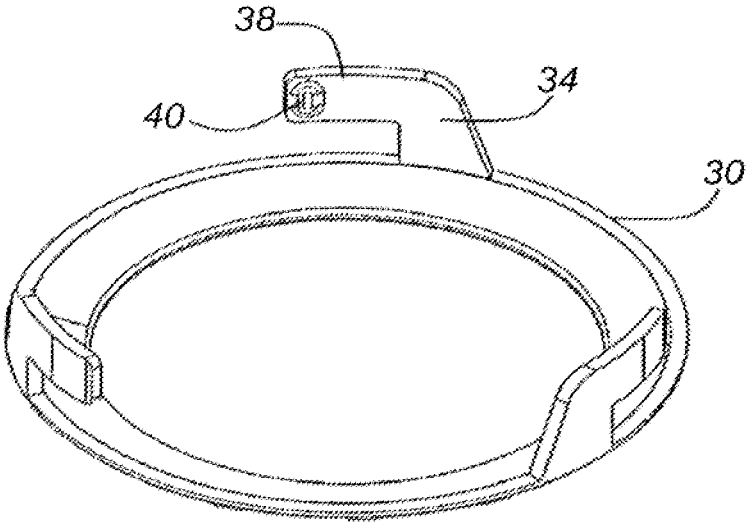
FIG. 3 shows the bezel according to this embodiment.

FIG. 3 shows the bezel 30, the outer contour of which includes several angularly distributed tabs 34 which are oriented towards the front and having a globally cylindrical shape, which each comprise, successively from such contour, an axial part and a circumferential part 38, the end of which includes a small boss 40 facing the axis. The tabs 34 are provided to adjust in the cylindrical housing 4 of the middle 2 by axially sliding from the rear side.

Figure 4:
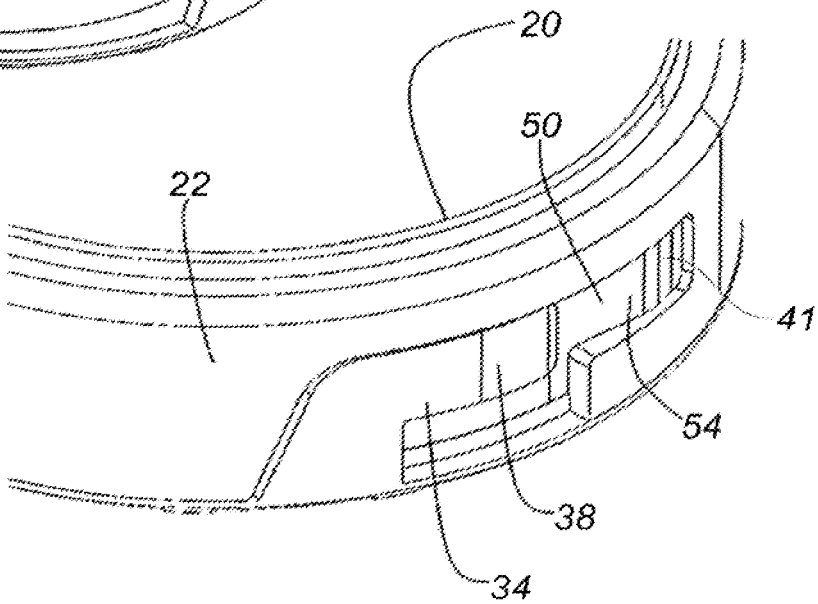
FIGS. 4 and 5 are perspective views of the assembly of the bezel on the capsule according to this embodiment, successively prior to, and after the locking rotation thereof.
Figure 5:
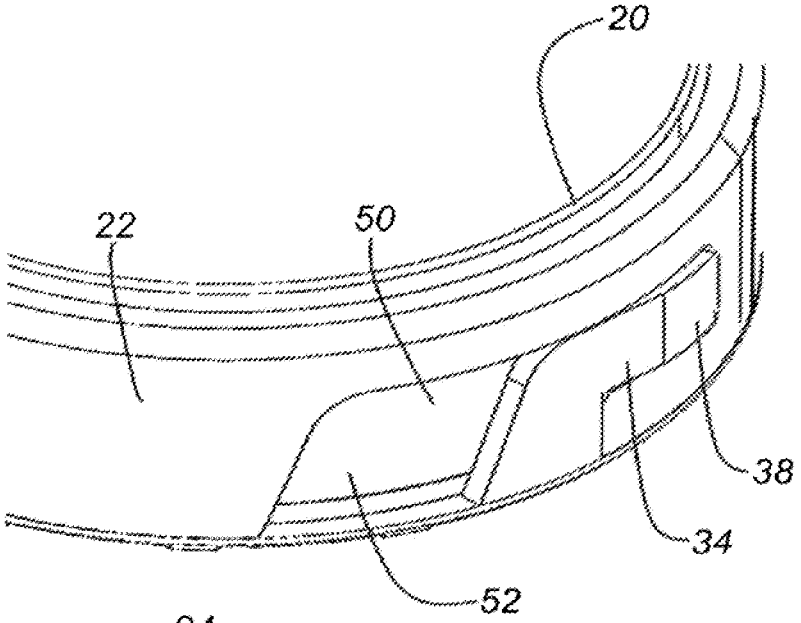

FIGS. 4 and 5 show the capsule 20, the cylindrical outer contour 22 of which comprises several angularly distributed outer grooves 50, in this embodiment three of them, which each comprise a first axial part 52 opening towards the back.

As an alternative solution, a different number of outer grooves 50 and tabs 34 can be provided.

Figure 6:
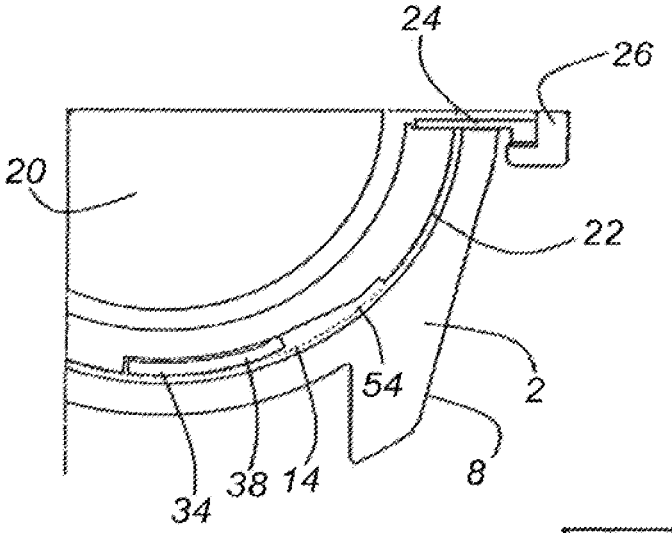
FIGS. 6 and 7 are partial sectional rear views of the assembly of the bezel, along the cross-sectional plane going through the crown axis, according to this embodiment, successively prior to, and after the locking rotation thereof.

The first part 52 of each outer groove 50 can receive, in its thickness, a whole tab 34 in an assembling position, as shown in FIGS. 4 and 6.

For each groove 50, the first axial part 52 is extended by a second circumferential part 54 separated from the rear face of the capsule 20 which has a bottom which gradually rises radially outwards in a slope. The bottom has a recess 41, for instance formed by grooves and/or scratches, so that the boss 40 can be received therein, in the assembled position of the bezel 30 after it has rotated till blocked. Such a boss 40, combined with such a recess 41 thus form a means for securing rotation which makes it possible to block the assembled position of the bezel 30 relative to the capsule 20 so that, to move in the reverse direction, i.e. a rotation for unlocking the bezel 30 relative to the capsule 20, a safety catch has to be overtaken, which requires a predetermined force, as a safety measure to make sure the bezel 30 cannot pivot further to friction and/vibration, when the watch is worn on a user's wrist.

The watch case is assembled as follows. In a first step, the bezel 30 is positioned by being fitted on the back of the capsule 20, with each tab 34 being totally inside a first axial part 52 of a groove 50.

The capsule 20 with the bezel 30 is then inserted into the housing 4 of the middle 2. The tube 24 of the crown 26 is positioned so as to face the slot 12 of the middle 2, to enter such slot. The mark "OPEN" 62 is opposite the radial mark 60.

Figure 7:
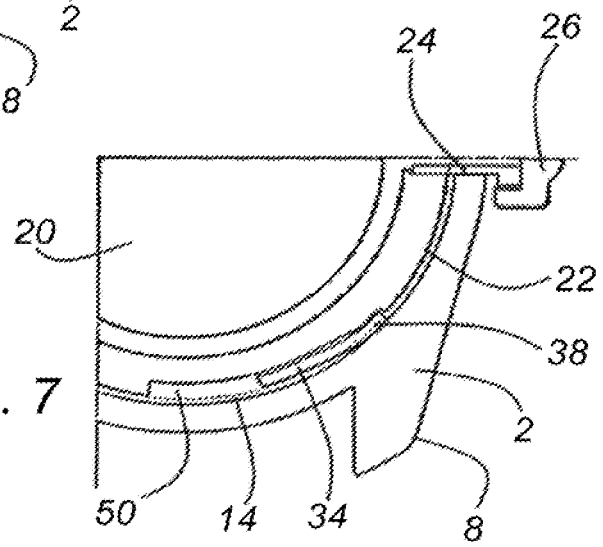
Figure 8:
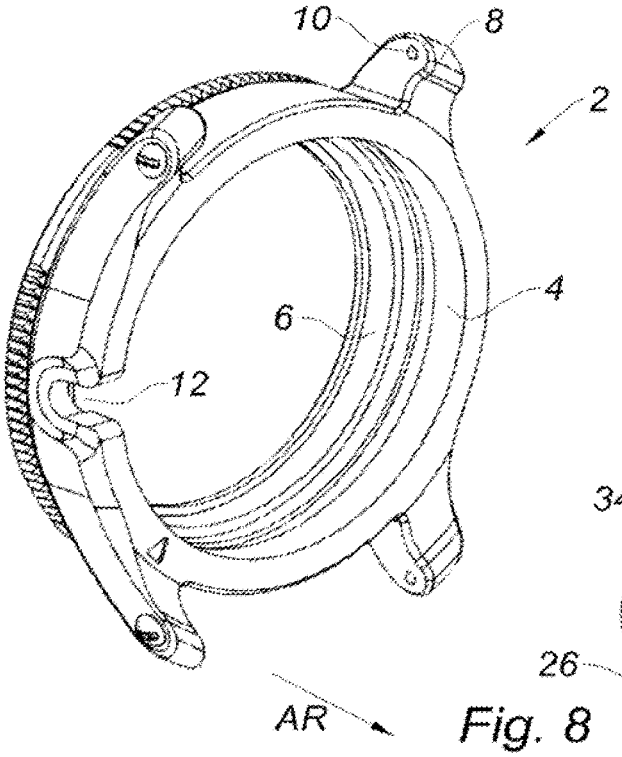
FIG. 8 shows a watch case according to a second embodiment of the invention, with the capsule having its bezel separated from the middle.
Figure 9:
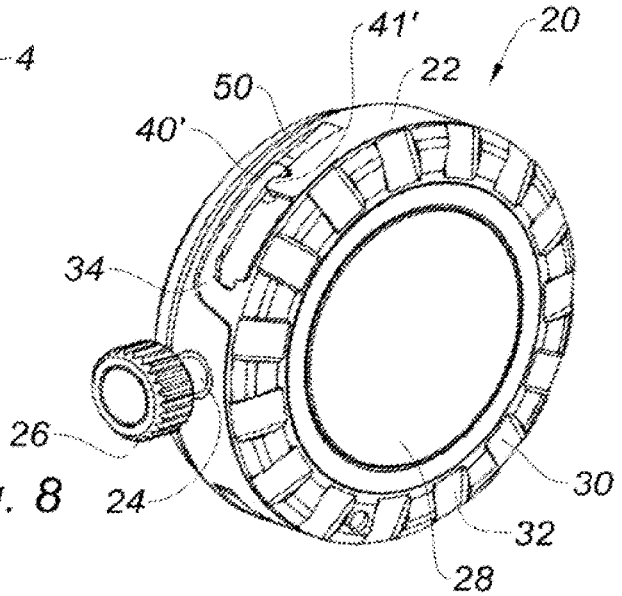
FIG. 9 shows the capsule contour part according to this second embodiment.
Figure 9:
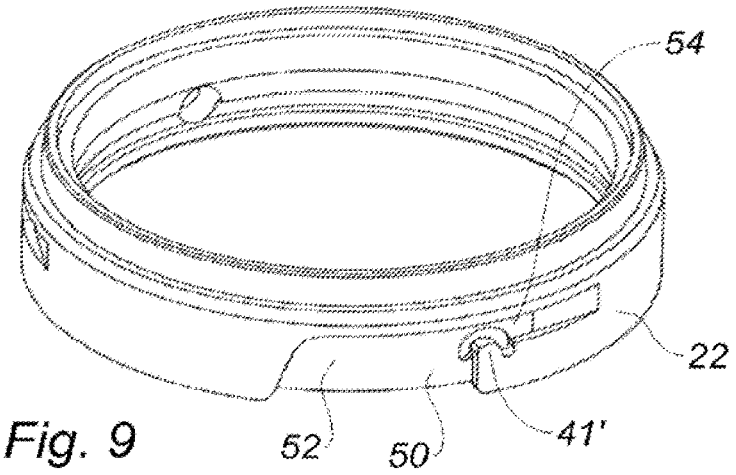
Figure 10:
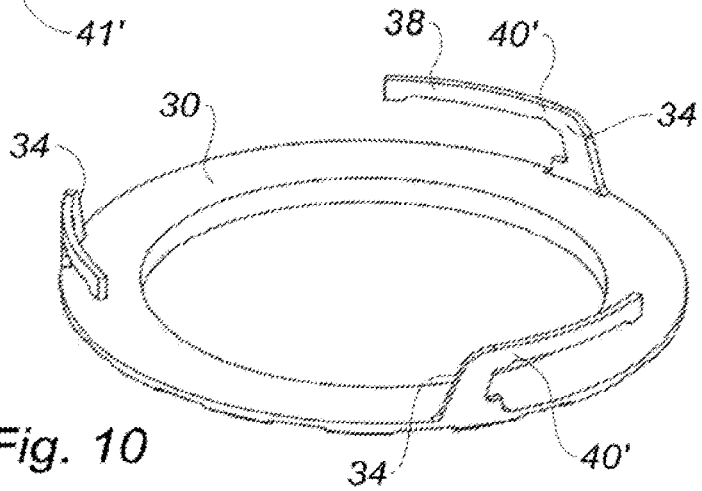
FIG. 10 shows the bezel according to the second embodiment.
Figure 11:
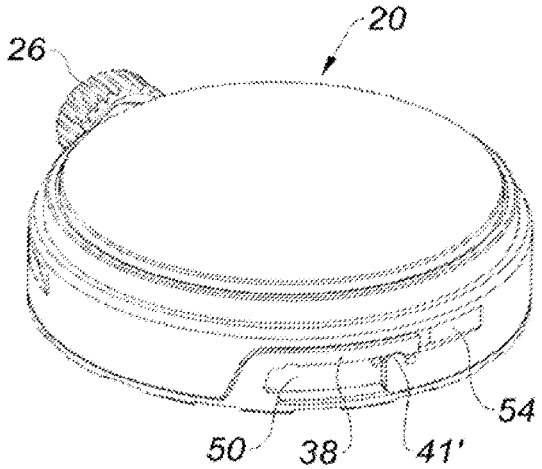
FIGS. 11 and 12 are perspective views of the assembly of the bezel on the capsule according to the second embodiment, successively prior to, and after the locking rotation thereof.
Figure 12:
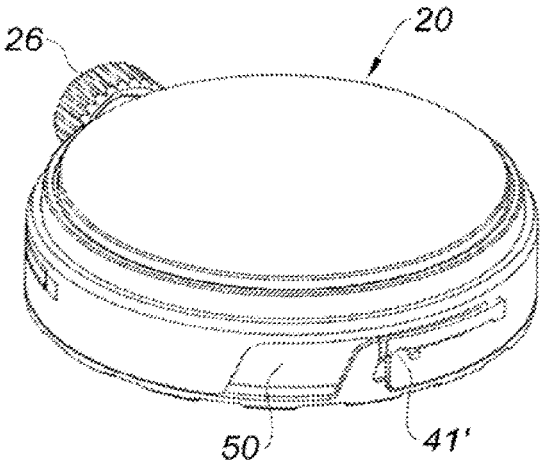
Figure 13:
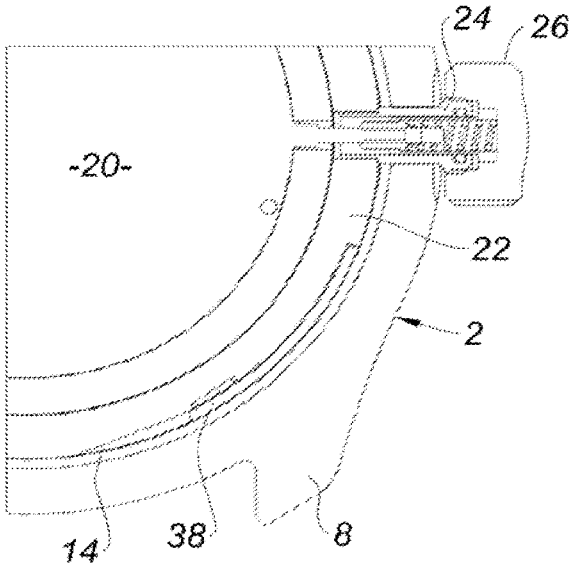
FIGS. 13 and 14 are partial sectional rear views of the assembly of the bezel, along the cross-sectional plane going through the crown axis, according to the second embodiment, successively prior to, and after the locking rotation thereof.
Figure 14:
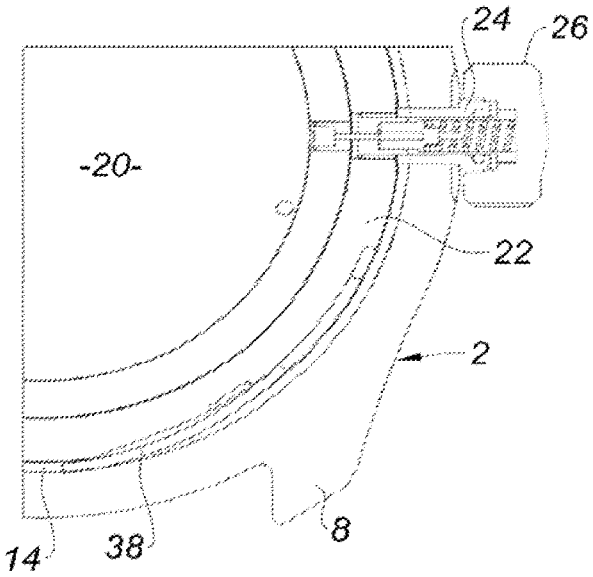

In a following step, the bezel is rotated clockwise by hand, using the raised shapes 32 of the bezel 30, to have the mark "CLOSE" opposite the radial mark 60, as shown in FIGS. 5 and 7.

The circular part 38 of each tab 34 is thus engaged in the second part 54 of the matching groove 50, and this circumferential part is raised outwards because of the boss 40 bearing on the slope of the bottom of this rising second part. The boss 40 bears on the slope of the groove 50 with a reduced surface, which reduces the friction upon rotating the bezel 30.

The circumferential part 38 of each tab 34 enters the circular groove 14 of the housing 4 of the middle 2 after a radial motion outwards, and upon completion of the rotation, is blocked at the bottom of such groove. The sufficient rotation of the bezel 30 is ensured by the mark "CLOSE" 64 facing the radial line 60, which guarantees the blocking of the tabs 34 which are sandwiched between the bottom of the groove 50 and that of the circular groove 14.

During the rotating motion of the bezel 30, the capsule 20 is held stationary relative to the middle 2, specifically by the tube 24 of the crown 26, in one piece with the capsule 20 which is fitted in the slot 12 of such middle. This makes the pivoting of the bezel 30 relative to the capsule 20 and thus the displacement of the tabs 34 in the grooves 50 easier.

The bezel 30 and the capsule 20 are thus efficiently blocked in the middle 2, with little risk of disassembling, wear or failure over time.

Generally speaking, the blocking of the capsule 20 in rotation around the axis thereof relative to the middle 2 is provided by the tube 24 of the adjustment knob in one piece with the capsule 20 close fit in the slot 12 of the middle. The blocking in translation of the capsule 20 along the axis is provided by the tabs 34 engaging into the circular groove 14 of the middle 2. The bezel 30 is held in place and bears on the back of the capsule 20, which blocks same in the housing 4 of the middle 2.

FIGS. 8 to 14 show a watch case according to a second embodiment. This second embodiment is specifically different from the first one mainly in that the means for securing rotation is no longer formed by the boss 40 which engages in a matching recess 41, in an assembled position after rotating till blocked, but by a slit 40' provided in the circumferential part 38 of each tab 34 and wherein a matching protrusion 41', 15 engages in an assembled position after rotating till blocked.

Such means for securing rotation makes it possible to block the assembled position of the bezel 30 relative to the capsule 20 so that, to move in the reverse direction, i.e. pivoting the bezel 30 relative to the capsule 20 in the unlocking direction, in order to open the case, a safety catch, which secures the assembly and prevents any unduly rotation of the bezel 30 has to be overtaken. It should be noted that, in the case of the slit 40', the safety catch is positioned along an axis substantially parallel to the axis of the capsule 20, whereas in the case of the boss 40, such safety catch is substantially radial relative to said axis, because the slit is oriented substantially axially relative to the main axis.

The invention is described above by way of example. It should be understood that the person skilled in the art is able to carry out different embodiments of the invention without departing from the scope of the invention.

The invention claimed is:

1. A watch case comprising:

a capsule configured to receive a watch mechanism arranged along a main axis of the capsule, the capsule comprising a front side configured to receive a watch face of the watch mechanism, a middle surrounding said capsule and provided with an essentially cylindrical housing open towards a back of the middle from which the middle receives the capsule; and a bezel placed against a back of the capsule, the bezel comprising tabs arranged on an outer contour of the capsule, wherein the bezel is pivotable relative to the capsule, and wherein the housing has relative to the main axis of the capsule, an angular position for assembling the capsule and the bezel through an axial sliding into the housing of the middle, and a different angular position for blocking the bezel in which, after pivoting of the bezel relative to the capsule, the tabs are configured to be partially inserted into at least one groove having a circular orientation produced in a cylindrical part of the housing of the middle.

2. The watch case according to claim 1, wherein the outer contour of the capsule comprises outer grooves which receive the tabs, having a bottom sloping in the circumferential direction.

3. The watch case according to claim 1, wherein the bezel has, on a contour of the bezel, marks which indicate assembling and blocking angular positions.

4. The watch case according to claim 1, wherein the tabs have, from a circular contour of the bezel, an axial part, then a circumferential part provided to be inserted into a circular groove.

5. The watch case according to claim 1, wherein the bezel comprises, on a back of the bezel, a circular contour which is integrated in a step provided around a rear face of the capsule.

6. The watch case according to claim 5, wherein a circular contour of the bezel has a conical shape which fits on a matching shape at a bottom of the step of the rear face of the capsule.

7. The watch case according to claim 1, wherein the bezel has raised shapes on a contour of the bezel.

8. The watch case according to claim 1, wherein the middle comprises a shape for blocking the capsule in rotation, while allowing the bezel to pivot relative to the capsule.

9. The watch case according to claim 8, wherein the shape for blocking the capsule in rotation is a radial slot receiving a tube surrounding an axis of an adjusting crown of the capsule.

10. A watch middle comprising:

an essentially cylindrical housing open towards a back of the watch middle, the housing being configured for assembly with a capsule and a bezel, the housing being configured to receive the capsule containing a watch mechanism, and the housing being configured to hold the capsule which is held in place, in a blocking position for blocking the bezel and the capsule in the watch middle, by the bezel bearing against a back of the capsule, the bezel comprising tabs arranged on an outer contour of the capsule;

in a cylindrical part of the housing, at least one groove having a circular orientation, provided for partly receiving the tabs, in the blocking position; and a radial slot configured for blocking the capsule in rotation while allowing the bezel to pivot relative to the capsule.

* * * * *